US009604825B2

(12) United States Patent
Avila

(10) Patent No.: US 9,604,825 B2
(45) Date of Patent: Mar. 28, 2017

(54) HOIST DEVICE AND METHOD

(71) Applicant: Andrew Avila, Fort Worth, TX (US)

(72) Inventor: Andrew Avila, Fort Worth, TX (US)

( * ) Notice: Subject to any disclaimer, the term of this patent is extended or adjusted under 35 U.S.C. 154(b) by 57 days.

(21) Appl. No.: 14/178,334

(22) Filed: Feb. 12, 2014

(65) Prior Publication Data

US 2015/0225212 A1 Aug. 13, 2015

(51) Int. Cl.

*B66C 23/44* (2006.01)
*B66C 23/70* (2006.01)
*B66C 23/36* (2006.01)

(52) U.S. Cl.

CPC ..... *B66C 23/44* (2013.01); *B66C 23/365* (2013.01); *B66C 23/701* (2013.01)

(58) Field of Classification Search

USPC ..... 212/299
See application file for complete search history.

(56) References Cited

U.S. PATENT DOCUMENTS 2,541,970 A * 2/1951 Pospisil ..... B66C 23/36 212/292
2,591,435 A 4/1952 Hunsaker et al.
2,611,580 A 9/1952 Troche et al.
3,111,225 A 11/1963 Miller et al.
3,642,155 A * 2/1972 Carlson ..... B60P 1/36 198/313
3,770,101 A * 11/1973 Carlson ..... B60P 1/36 198/632
3,794,296 A * 2/1974 Hasstedt ..... B66C 23/48 212/300
4,111,316 A * 9/1978 Wappler ..... B66C 23/44 212/180
4,179,034 A * 12/1979 Van Antwerp ..... A01D 87/003 414/338
4,216,941 A * 8/1980 Little ..... B66C 23/36 212/180
4,226,331 A * 10/1980 Dumond ..... B66C 23/44 212/258
4,260,064 A * 4/1981 Ekstam ..... B66C 23/702 212/231
4,269,396 A * 5/1981 Easterwood ..... B66C 23/44 212/177
4,270,628 A * 6/1981 Anderson ..... B66B 9/00 182/37

(Continued)

*Primary Examiner* — Emmanuel M Marcelo
*Assistant Examiner* — Michael Gallion
(74) *Attorney, Agent, or Firm* — Decker Jones P.C.; Brian K. Yost; Geoffrey A. Mantooth

(57) ABSTRACT

The hoist comprises a crosspiece, an insertion portion, and two folding members. The insertion portion may be inserted into a receiver. The folding members are each positioned near opposite ends of the crosspiece and are pivotally coupled to the crosspiece such that each folding member may be pivoted upward and towards each other. The folding members may be lengthened and shortened. When in a folded position, the folding members are retracted and turned inward so that each folding member aligns parallel to the crosspiece. When in the extended working position, a chain is coupled to a top portion of a vertical extension member to the coupling member such that the folding members are in an upright, lifting position. A winch cable extending from the crosspiece and through a pulley positioned near the coupling member is adapted for lifting an object.

8 Claims, 12 Drawing Sheets

(56) References Cited

U.S. PATENT DOCUMENTS 4,348,151 A * 9/1982 Olson ..... B60P 1/483 212/292
4,419,038 A 12/1983 Pendergraft
4,615,450 A * 10/1986 Kennard, Jr. ..... B66C 23/36 212/180
4,700,851 A * 10/1987 Reeve ..... B66C 23/36 212/175
4,782,962 A * 11/1988 Hackworth ..... B66C 23/48 212/178
4,872,581 A * 10/1989 Wedhorn ..... B66C 23/66 212/180
4,881,864 A * 11/1989 Amato ..... B66C 23/44 212/180
4,930,970 A * 6/1990 Sunderland ..... B60P 1/5442 212/227
5,211,526 A * 5/1993 Robinette ..... B60P 1/5471 212/238
5,281,078 A * 1/1994 Mills, Jr. ..... B66C 23/44 212/180
5,341,898 A * 8/1994 Baziuk ..... E04G 3/34 182/142
5,480,041 A * 1/1996 Turner ..... B66C 23/36 212/273
5,540,537 A 7/1996 Welch
5,733,092 A * 3/1998 Barry ..... B65G 63/045 212/319
5,752,799 A * 5/1998 Carey ..... B60P 1/5471 224/403
5,788,095 A * 8/1998 Watson ..... B66C 23/44 212/180
5,791,858 A 8/1998 Sasser
5,971,177 A 10/1999 Carter
6,007,289 A 12/1999 Kruse et al.
6,042,328 A 3/2000 McVaugh
6,065,621 A * 5/2000 Fatemi ..... B66C 23/48 212/264
6,095,349 A 8/2000 O'Meara
6,152,675 A 11/2000 Compton
6,616,397 B1 9/2003 Lester
6,821,075 B2 * 11/2004 van der Horn ..... B60P 1/5452 212/180
7,374,388 B2 5/2008 Holt
7,544,032 B1 * 6/2009 Scott, Jr. ..... B60P 1/5471 280/847
7,828,017 B2 * 11/2010 Hurley ..... F16K 31/46 137/899
7,845,622 B1 12/2010 Riggs
2003/0000906 A1 * 1/2003 Perkins ..... B66C 23/44 212/180
2004/0234367 A1 * 11/2004 Pacini ..... B60R 9/06 414/543
2006/0254998 A1 * 11/2006 Davis ..... F16L 1/06 212/238
2007/0221600 A1 * 9/2007 Davis ..... B66C 23/36 212/270
2009/0152227 A1 6/2009 Thompson et al.
2009/0230071 A1 * 9/2009 Thompson ..... B66C 23/44 212/292
2009/0277857 A1 * 11/2009 Rice ..... B66C 23/44 212/302
2010/0200822 A1 * 8/2010 Kitchens, Sr. ..... B66C 23/44 254/326
2010/0295005 A1 * 11/2010 Riggs ..... B66C 23/44 254/326
2011/0053482 A1 * 3/2011 McKenzie ..... A22B 5/06 452/187
2012/0048823 A1 * 3/2012 Kriner ..... B66C 23/44 212/180
2012/0211456 A1 * 8/2012 Wang ..... B66C 23/44 212/180
2013/0075353 A1 * 3/2013 Thompson ..... B66C 23/44 212/180
2013/0153841 A1 6/2013 Schumacher
2014/0150232 A1 * 6/2014 Arthur ..... B66C 23/00 29/402.08

* cited by examiner

HOIST DEVICE AND METHOD

BACKGROUND OF THE INVENTION

1. Field of the Invention

The present invention relates generally to a hoist, or lifting device, and specifically to a portable hoist device that may be mounted to a vehicle receiver and used to lift heavy objects.

2. Description of the Prior Art

Workers often find it necessary to lift heavy objects while out in the field. A hoist is often used for such lifting. However, many workers drive trucks or other vehicles that are not equipped with a hoist. A number of attempts have been made to provide hoists for mounting to a vehicle. For example, U.S. Pat. No. 2,591,435, Hunsaker et al., U.S. Pat. No. 3,111,225, Miller et al, and U.S. Pat. No. 2,611,580, Troche et al. teach derrick style lifting devices configured to be mounted on a utility truck. U.S. Pat. No. 4,419,038, Pendergraft teaches a foldable hoist assembly comprising an elongated column with a boom pivotally mounted at its outer end to be moveable from a stored position alongside the column to its operating position. U.S. Pat. No. 5,540,537, Welch, teaches a hoist which may be mounted to a trailer hitch drawbar of a vehicle. U.S. Pat. No. 5,791,858, Sasser, teaches a vehicle mounted game skinning device comprising a vertical support unit having a hitch connection member connected on one end to a vehicle hitch and connected on the other end to a vertical column member which slideably receives a boom arm member. U.S. Pat. No. 5,971,177, Carter teaches a portable truck crane which mounts in the hitch receiver of a vehicle, and lifts objects. U.S. Pat. No. 6,007,289, Kruse et al, teaches a device which may be mounted to the rear portion of a vehicle to lift and remove a personal mobility vehicle into and from the rear portion of the vehicle. U.S. Pat. No. 6,042,328, McVaugh teaches a lifting device for attachment to a vehicle trailer hitch. U.S. Pat. No. 6,095,349, O'Meara teaches a knock-down portable hoist which includes a vertical first member attachable to a support member, U.S. Pat. No. 6,152,675, Compton teaches a portable, fold-up hoist for attachment to a vehicle via a receiver hitch. U.S. Pat. No. 6,616,397, Lester teaches a portable hoist system and method of use in combination with the rear bed and ball hitch of a pick-up truck, the system being capable of being stored in a portable bag, U.S. Pat. No. 7,374,388, Holt teaches a game hoist apparatus that is attachable to a tow hitch of a pickup truck or similar vehicle. U.S. Pat. No. 7,845,622, Riggs teaches a hoist device attachable to the trailer hitch of a vehicle and comprises a telescopic boom of a pair of rectangular tubular members attachable slidably to a base support member, US 20040234367, Pacini teaches a modified drawbar and specialized hoist that fits into the receiver on a truck hitch frame. US 20090152227, Thompson et al. teaches an apparatus that mounts to a receiver hitch and comprises a pivoting tower to form a lifting hoist that is foldable and retractable US 20130075353, Thompson teaches a self-locking folding crane apparatus that can be left on a vehicle or cart while it is in either an operative or stowed state. US 20130153841, Schumacher teaches a winch operated hoist comprising a vertical member and a pivoting horizontal member.

Although several of these references teach portable hoisting devices, none of the prior art devices are adapted to be both heavy duty and compact when stowed.

What is needed is a device that permits large objects to be easily lifted and which can be easily transported, set up, used, and which may be easily stowed. The device and method of the present invention allows large objects to be lifted easily and can be easily transported, set up, used, and stowed.

SUMMARY OF THE INVENTION

A device, generally comprising a crosspiece, an insertion portion, and two folding members, is provided. The insertion portion is positioned near a center of the crosspiece and extends outward from the crosspiece such that the insertion portion may be inserted into a vehicle mounted receiver. The folding members are each positioned on an upper surface of the crosspiece near opposite ends of the crosspiece. The folding members are pivotally attached to the crosspiece such that each folding member may be pivoted upward. Each folding member comprises a hinge that permits each folding member to be pivoted towards the other folding member. Each folding member further comprises a telescopic arrangement such that the folding members may be lengthened and shortened. When in a lengthened position, the folding members may be coupled to each other at distal ends with a coupling member. When in a folded position, the folding members are retracted and turned inward so that each folding member aligns parallel to the crosspiece. A vertical member extends upward from the insertion member and is adapted to be coupled with a vertical extension member. When in the extended working position, a chain is coupled to a top portion of the vertical extension portion to the coupling member such that the folding members are in an upright, lifting position. A winch cable may be threaded from an area proximate to the crosspiece and through a pulley positioned near the coupling member such that an object may be lifted.

DESCRIPTION OF THE PREFERRED EMBODIMENT

Figure 1:
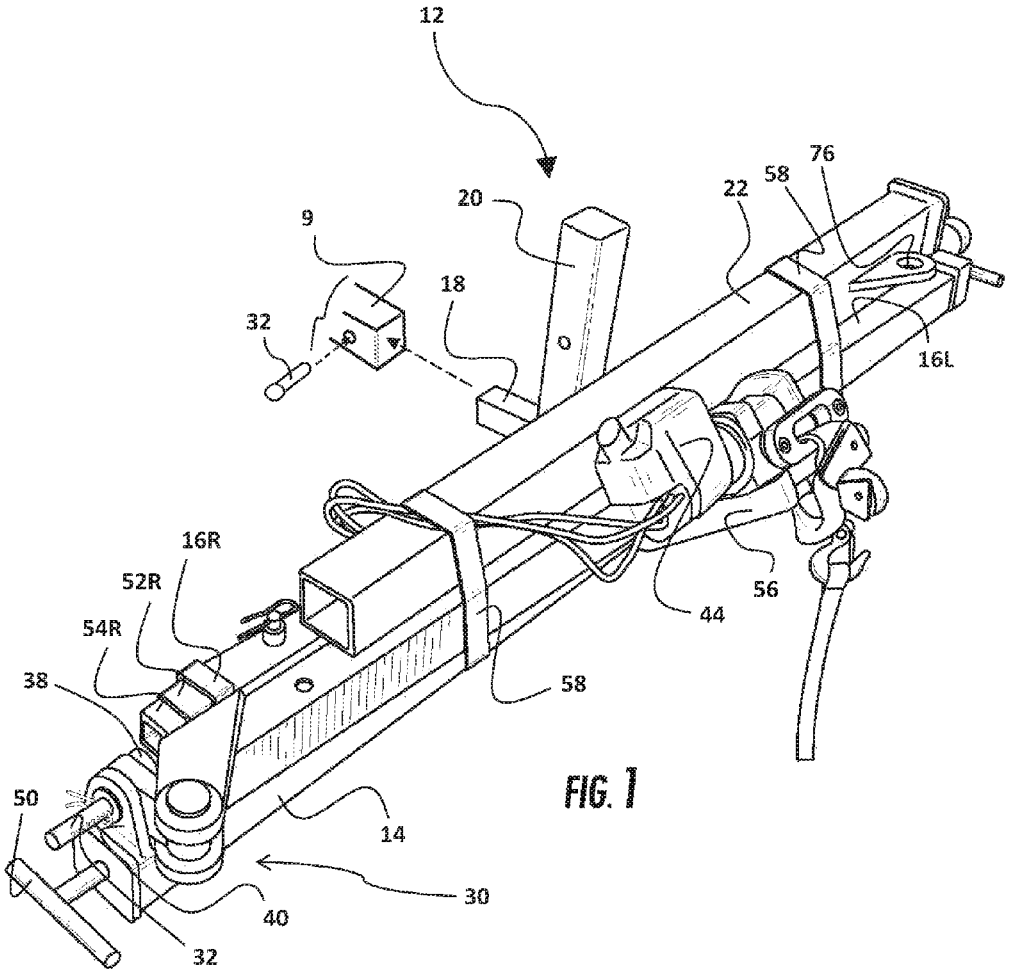
FIG. 1 is a perspective view of the hoist device in a folded position, in accordance with a preferred embodiment.

Referring to FIGS. 1-12, there is shown the device 12 in various embodiments and in accordance with a preferred embodiment. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

A. General Overview

Referring to the figures, as a general overview, the device 12 of the preferred embodiment generally comprises a crosspiece 14, a receiver insertion member 18, and two folding members 16L, 16R. The receiver insertion member 18 is positioned near a center of the crosspiece 14 and extends outward from the crosspiece 14 such that the insertion member 18 may be inserted into a receiver 9 of a vehicle 10. The folding members 16L, 16R are each positioned on an upper surface of the crosspiece 14 near opposite ends of the crosspiece 14. The folding members 16L, 16R comprise a pivoting assembly 30 coupling each folding member 16L, 16R to the crosspiece 14 such that each folding member 16L, 16R may be pivoted upward and towards each other 16L, 16R. Each folding member 16L, 16R comprises a telescopic arrangement such that the folding members 16L, 16R may be lengthened and shortened. When in a lengthened position, the folding members 16L, 16R may be coupled to each other at the ends with a coupling member 60. When in a folded position, the folding members 16L, 16R are retracted and turned inward so that each folding member 16L, 16R aligns parallel to the crosspiece 14. A vertical insertion member 20 extends upward from crosspiece 14. The vertical insertion member 20 is adapted to be coupled with a vertical extension member 22. When the device 12 is in the extended working position, a chain 24 extends from a top portion of the vertical extension member 22 to the coupling member 60 such that the folding members 16L, 16R are in an upright, lifting position. A winch cable 46 may be threaded from an area proximate to the crosspiece 14 and through a pulley 66 positioned proximate to the coupling member 60 such that an object may be lifted.

The specific assemblies and sub-assemblies of the device 12 of the preferred embodiment will be discussed in more detail below.

1. Crosspiece

In FIGS. 1-3 & 7-9, there is shown the crosspiece 14. The crosspiece 14 of the preferred embodiment comprises a length of square tubing approximately the same length as the width of the vehicle 10. At each end of the crosspiece 14 are "T" shaped portions which comprise handles 50 with which the crosspiece 14 may be lifted. Coupled to the crosspiece 14 and extending outward therefrom is the receiver insertion member 18. Opposite the receiver insertion member 18 is a winch mount 56. In the preferred embodiment, when the device 12 is mounted on a vehicle 10, the receiver insertion member 18 extends from the crosspiece 14 towards the vehicle 10, and the winch mount 56 extends from the crosspiece 14 away from the vehicle 10, at an upward angle. The winch mount 56 is adapted for mounting of the winch 44. An inside bracket 38 and an outside bracket 40 of the pivoting assembly 30 are each positioned on an upper surface of the crosspiece 14 near opposite ends of the crosspiece 14.

2. Upper Extension Member

In the preferred embodiment, extending upward and perpendicular to the receiver insertion member 18 is the vertical insertion member 20. Removably coupled to the vertical insertion member 20 is the vertical extension member 22. In this embodiment, the vertical extension member 22 is a single piece as shown, for example, in FIGS. 2 & 8. In this embodiment, the vertical insertion member 20 has external dimensions slightly smaller than the internal dimensions of the vertical extension member 22 to allow the vertical insertion member 20 to be inserted into and, thus, nested within the vertical extension member 22 and secured with the pin 32 or other attachment device.

Figure 7:
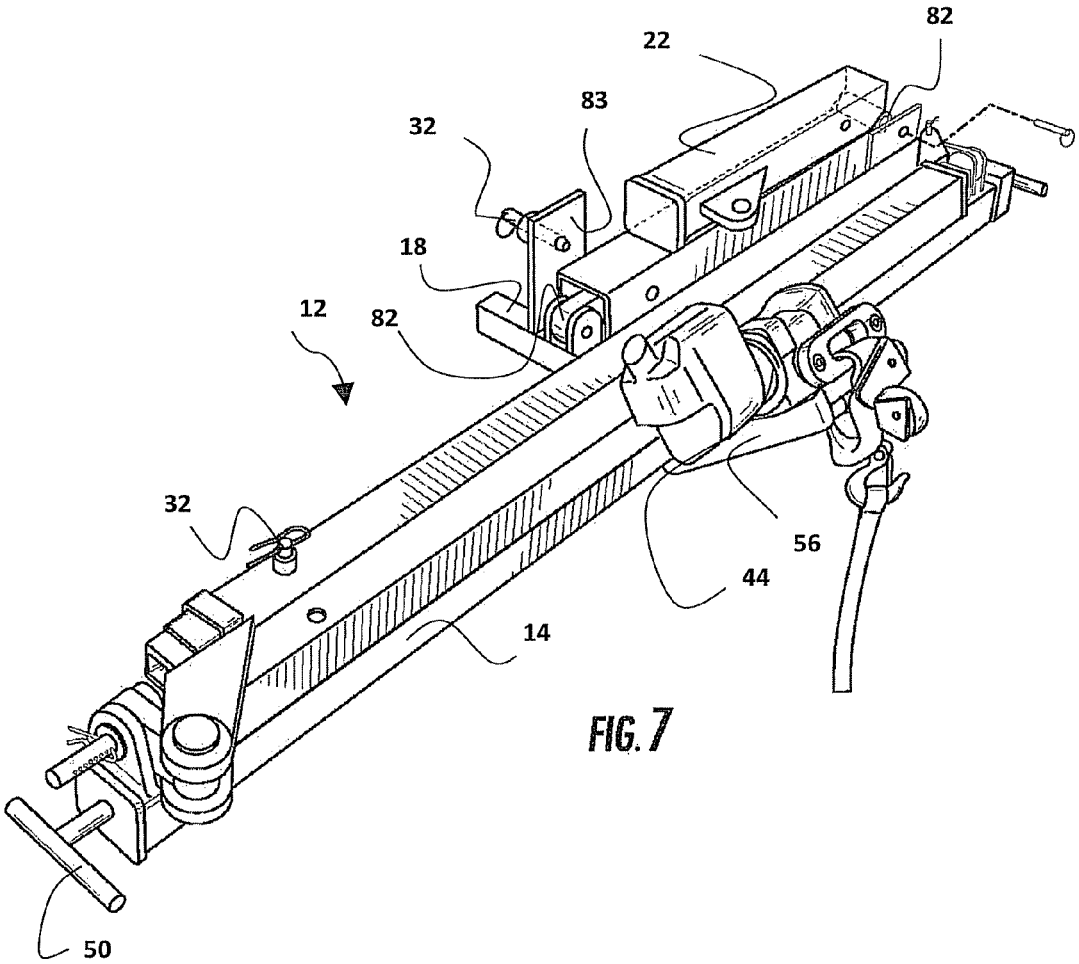
FIG. 7 is a perspective view of the hoist device in a folded position, in accordance with another embodiment.

In other embodiments, as shown, for example, in FIG. 7, the vertical extension member 22 comprises multiple pieces coupled to one another with a hinge assembly 82. In this embodiment, the vertical extension member 22 may be secured in a vertical position with the pin 32 and vertical plate 83.

At an upper end of the vertical extension member 22 is a vertical plate comprising a through opening 76 adapted to receive the chain 24 which, when the device 12 is in an extended position, may be coupled to the through opening 76 of an vertical boom plate 72 of the coupling member 60. A pulley 66 may be mounted on the vertical extension member 22.

3. Receiver Coupling

The receiver insertion member 18 is positioned near the center of the crosspiece 14 and extends outward from the crosspiece 14 such that the insertion member 18 may be inserted into a receiver 9 of a vehicle 10. The insertion member 18 and receiver 9 comprise square tubing. The receiver insertion member 18 has external dimensions slightly smaller than the internal dimensions of the receiver 9 to allow the receiver insertion member 18 to be inserted into and, thus, nested within the receiver 9 and secured with the pin 32 or other attachment device. The receiver insertion member 18, when in use, is inserted into the receiver 9 of the vehicle 10 and has a hole 48 to allow a pin 32 or other attachment device to secure the receiver insertion member 18 to the receiver 9.

4. Pivoting Assembly

Figure 4:
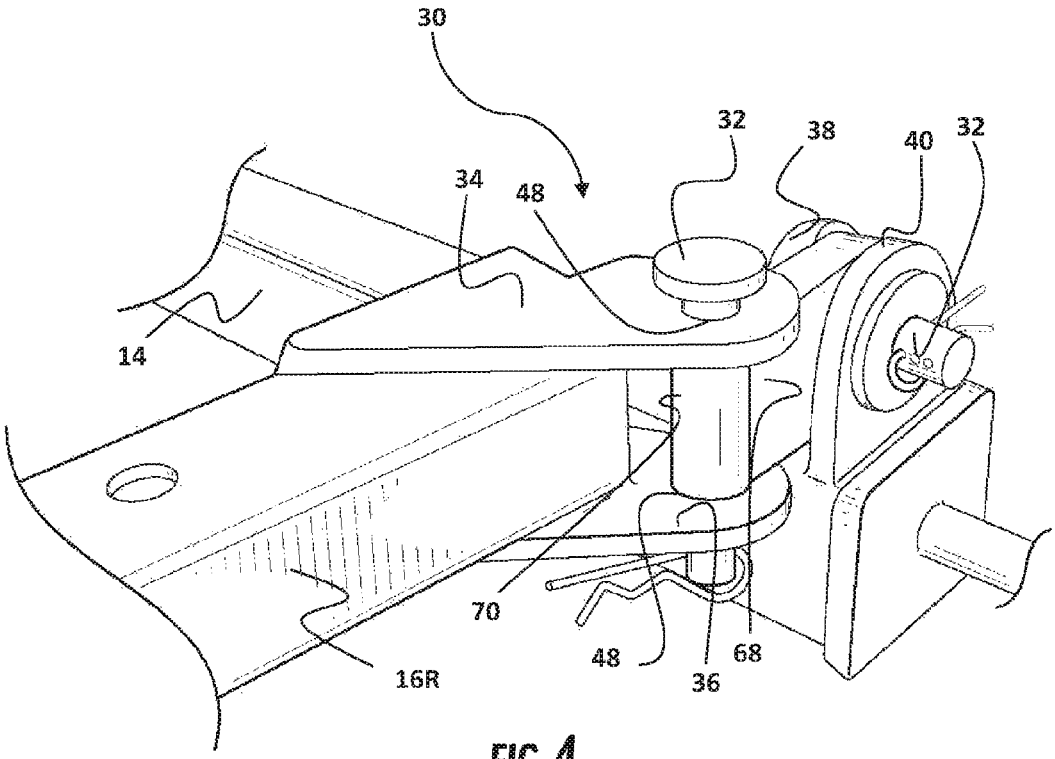
FIG. 4 is a perspective view of the folding member pivoting portion of the hoist device, in accordance with a preferred embodiment.

As best shown in FIG. 4, the pivoting assembly 30 comprises the inside bracket 38 and an outside bracket 40, a tongue portion 68, and upper 34 and lower 36 plates. The inside bracket 38 and an outside bracket 40 extend upward from an upper surface of the crosspiece 14 near opposite ends of the crosspiece 14 and are spaced apart from one another a sufficient distance to permit a first end of the tongue portion 68 to be inserted therebetween. The inside bracket 38, outside bracket 40, and the tongue portion 68 each comprise holes 48 adapted to receive pin 32 which may be inserted therein. When so inserted, the pin 32 secures the tongue portion 68 in position between the inside and outside brackets 38, 40 and permits the tongue portion 68 to pivot. As the tongue portion 68 is rotationally coupled to the inside bracket 38 and outside bracket 40, and, as will be discussed in more detail below, the folding member 16R, 16L is coupled to tongue portion 68 via the upper and lower plates 34, 36, and pin 32, the folding member 16R, 16L is capable of upward and downward movement.

A second end of the tongue portion 68 comprises a tongue cylinder 70. This tongue cylinder 70 is adapted to be rotationally positioned between the upper 34 and lower 36 plates. A pin 32 or other attachment device inserted though respective holes 48 the upper 34 and lower 36 plates and the tongue cylinder 70 secures the upper 34 and lower 36 plates to the tongue portion 68. As the upper and lower plates 34, 36 are coupled to the tongue cylinder 70 and the folding member 16 is coupled to the upper and lower plates 34, 36, the folding member 16 is capable of inward and outward movement.

5. Boom Assembly

Figure 5:
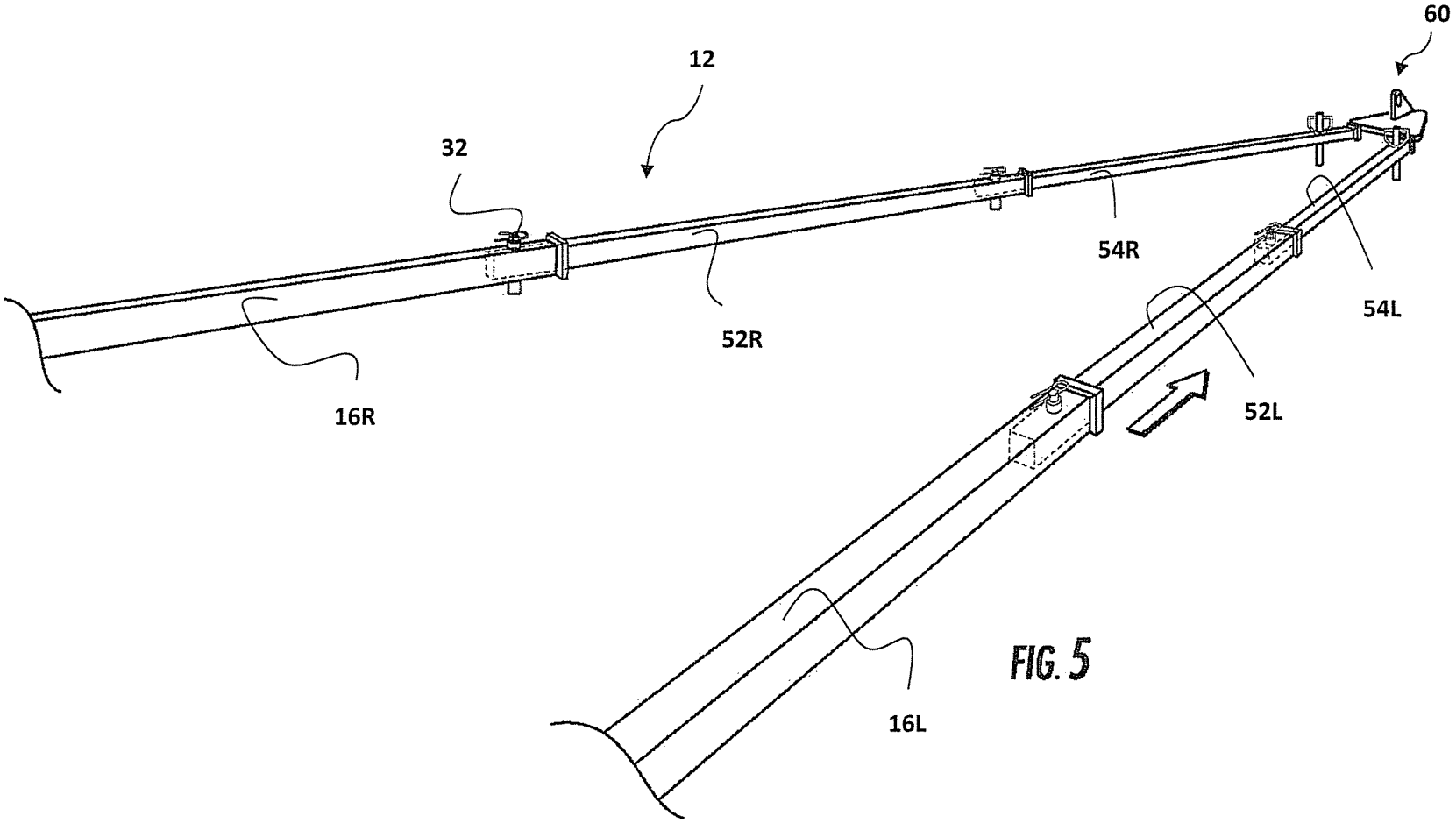
FIG. 5 is a perspective view of the folding members in an extended position, in accordance with a preferred embodiment.
Figure 6:
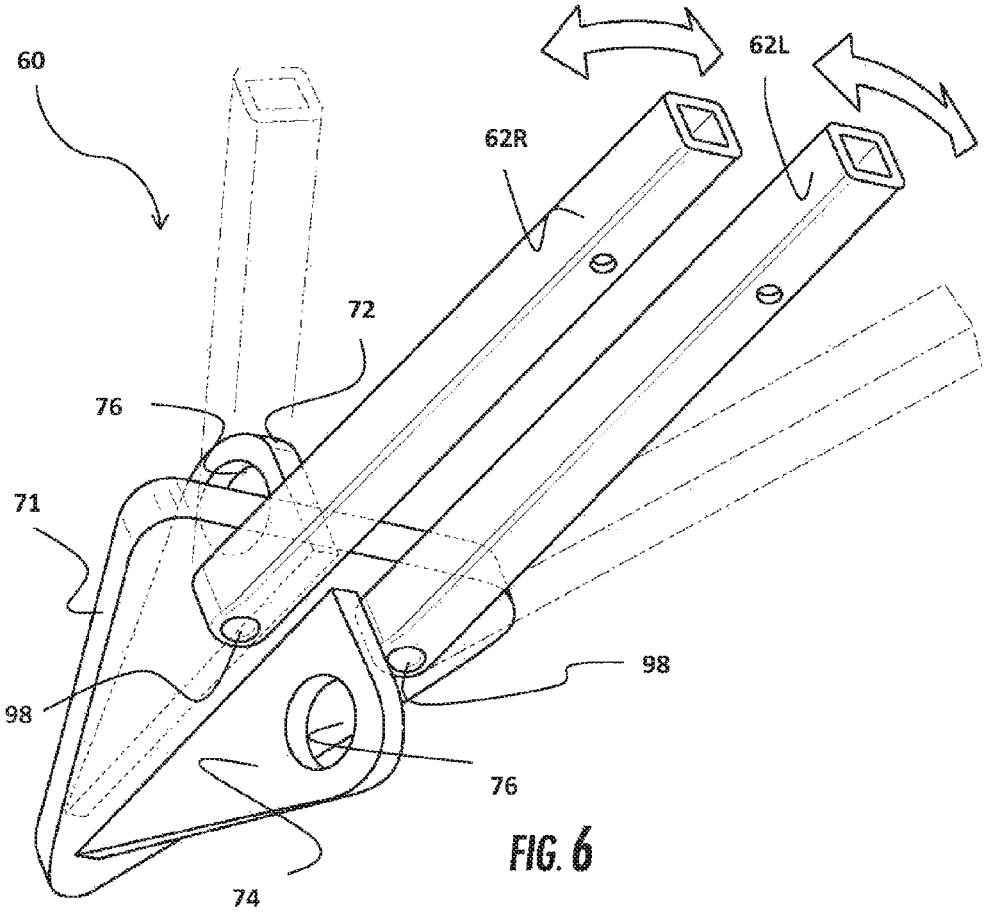
FIG. 6 is a perspective view of the coupling member, in accordance with a preferred embodiment.

Referring to FIG. 5, the boom assembly 68 of the preferred embodiment comprises the folding members 16L, 16R which further comprise the central members 52L, 52R, and distal members 54L, 54R, and coupling member 60. In this embodiment, the folding members 16L, 16R, central members 52L, 52R, distal members 54L, 54R comprise square tubing. The folding members 16L, 16R comprise internal dimensions slightly larger than external dimensions of the central members 52L, 52R to allow the central members 52L, 52R to be inserted into and, thus, nested within the folding members 16L, 16R and secured with the pin 32 or other attachment device. In this arrangement, the respective folding members 16L, 16R are telescopically coupled to the respective central members 52L, 52R. The central members 52L, 52R comprise internal dimensions slightly larger than external dimensions of the distal members 54L, 54R to allow the distal members 54L, 54R to be inserted into and, thus, nested within the central members 52L, 52R and secured with the pin 32 or other attachment device. In this arrangement, the respective central members 52L, 52R are telescopically coupled to the respective distal members 54L, 54R.

The coupling member 60 comprises a horizontal boom plate 71, upper vertical boom plate 72, lower vertical boom plate 74, and boom coupling extension members 62L, 62R. The coupling member 60 is adapted to be coupled to the distal members 54L, 54R. When the coupling member 60 is coupled to the distal members 54L, 54R, the horizontal boom plate 71 is aligned generally parallel to the distal members 54L, 54R. The horizontal boom plate 71 of the preferred embodiment comprises a generally triangular plate material. In the preferred embodiment, the horizontal boom plate 71 is formed from two inch plate steel. The upper vertical boom plate 72 extends upward from the horizontal boom plate 71 such that the upper vertical boom plate 72 is perpendicular to the horizontal boom plate 71. The lower vertical boom plate 74 extends downward from the horizontal boom plate 70 such that the lower vertical boom plate 74 is perpendicular to the horizontal boom plate 71.

Coupled to a lower surface of the horizontal boom plate 71 are the coupling extension members 62L, 62R, The coupling extension members 62L, 62R of the preferred embodiment, each comprise square tubing extending at an angle from the horizontal boom plate 71. The distal members 54L, 54R comprise internal dimensions slightly larger than external dimensions of the boom coupling extension members 62L, 62R to allow the coupling extension members 62L, 62R to be inserted into and, thus, nested within the distal members 54L, 54R and secured with the pin 32 or other attachment device.

The upper vertical boom plate 72 and lower vertical boom plate 74 each comprise a through opening 76. As discussed above, the upper vertical boom plate 72 through opening 76 is adapted for coupling to a chain 24 which may be extended to the vertical extension member 22 through opening 76 and maintain the boom assembly 68 in an upright position.

Figure 12:
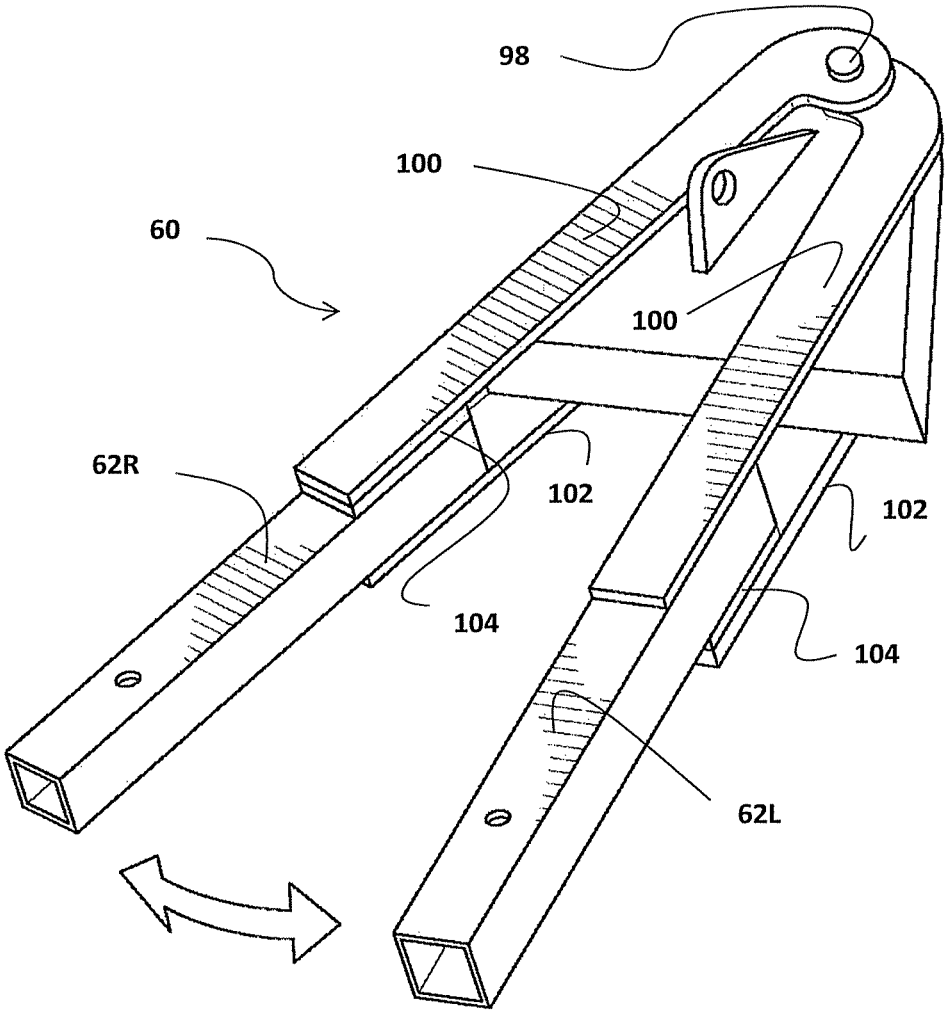
FIG. 12 is a perspective view of the coupling member, in accordance with another embodiment.

Referring to FIG. 12, another embodiment of the coupling member 60 is shown. In this embodiment, the boom coupling extension members 62L, 62R are hingedly attached to a single king pin 98. Each boom coupling extension member 62L, 62R of this embodiment comprises an upper boom coupling plate 100, a lower boom coupling plate 102, and a spacer 104.

Figure 3:
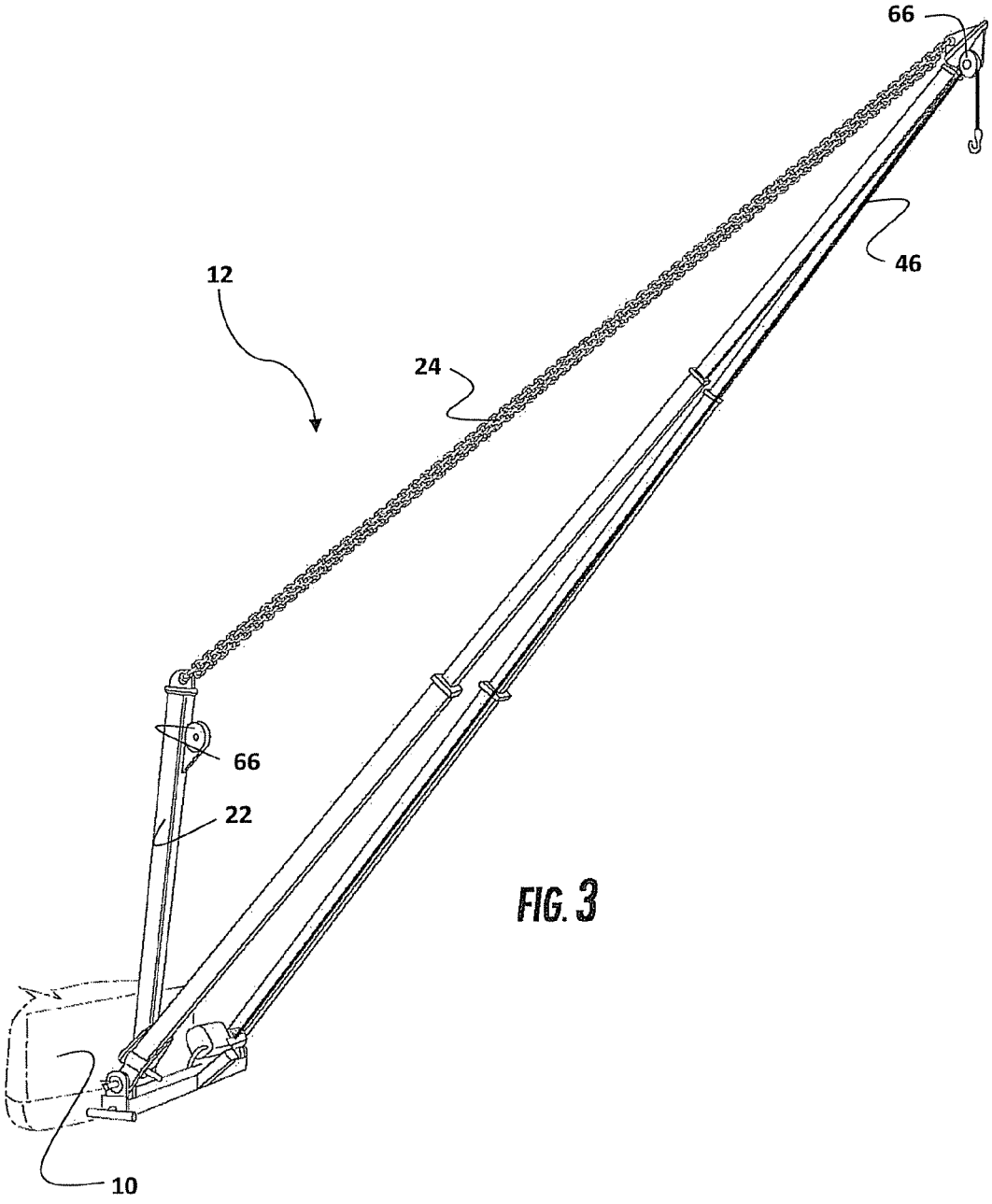
FIG. 3 is a perspective view of the hoist device in an extended position with the winch cable and hook extended, in accordance with a preferred embodiment.

One or more conventional and commercially available pulleys 66 may be mounted on the coupling member 60 or on the vertical extension member 22. For example, as shown in FIG. 3, the pulley 66 may be secured to the lower vertical boom plate 74.

B. Operation

Figure 8:
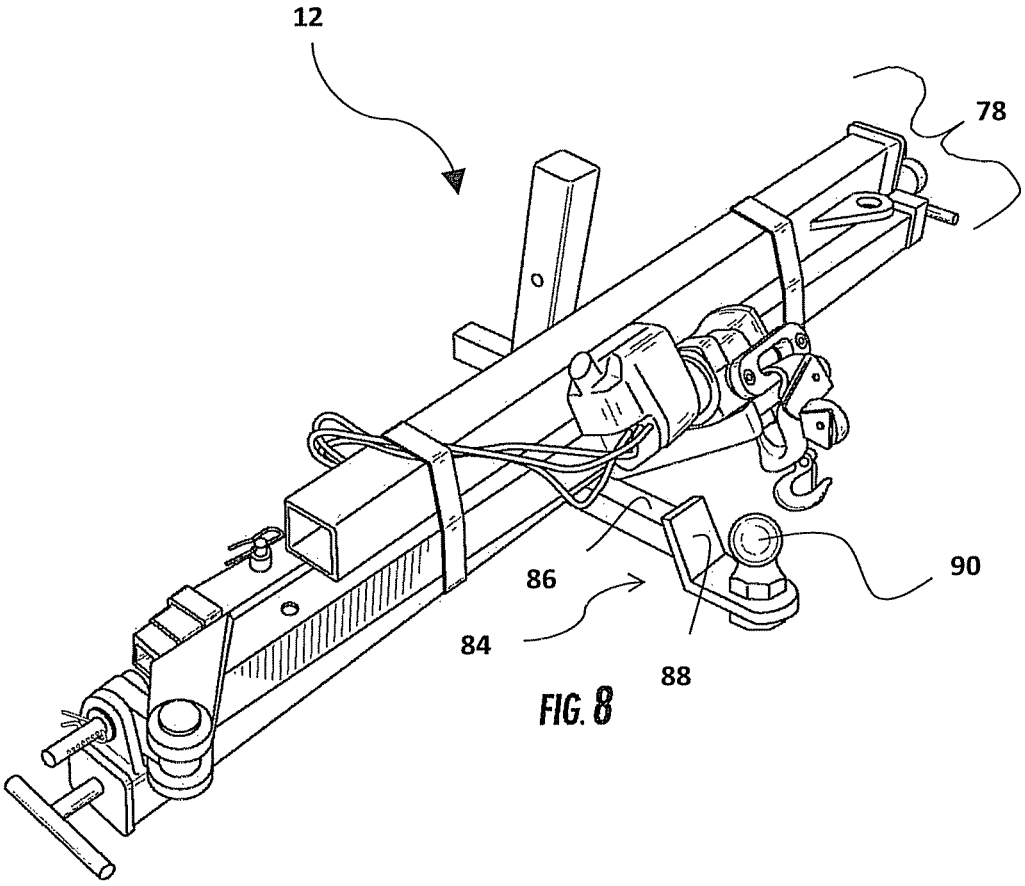
FIG. 8 is a perspective view of the hoist device in a folded position, in accordance with another embodiment.

In operation, the device 12 is adapted to be stored in a folded position as shown, for example, in FIGS. 1, 7, and 8 and extended from the folded position to an extended position as shown, for example, in FIGS. 2, 3, 5, and 9.

1. Stored Position

When in the stored position depicted in FIGS. 1, 7, and 8, the receiver insertion member 18 is inserted into the receiver 9 of the vehicle 10 and secured with the pin 32 or other attachment device such that the crosspiece 14 is in an elevated position relative to a driving surface. The folding members 16L, 16R, central members 52L, 52R, distal members 54L, 54R are fully retracted such that the respective distal members 54L, 54R are fully retracted within respective central members 52L, 52R, and respective central members 52L, 52R are fully retracted within respective folding members 16L, 16R. The folding members 16L, 16R are folded inward towards each other such that they are each generally parallel to the crosspiece 14. The vertical extension member 22 is position atop the folding members 16L, 16R. One or more bands 58 are wrapped around and secure a bundle 78 comprising the crosspiece 14, folding members 16L, 16R, and vertical extension member 22. The chain 24 and boom coupling member 60 may be stored in a separate location.

Referring to FIGS. 7 and 8, in other embodiments, the device 12 comprises a hingedly attached vertical extension member 22 (FIG. 7) and/or a trailer ball assembly 84 (FIG. 8). In embodiments, comprising the hingedly attached vertical extension member 22, the vertical extension member 22 is coupled to the receiver insertion member 18 with a hinge mechanism 82. The hinge mechanism 82 permits the vertical extension member 22 to be folded into a position generally parallel to the crosspiece 14, as shown in FIG. 7.

In some embodiments, comprising the trailer ball assembly 84, the trailer ball assembly 84 comprises a receiver insertion member 86 coupled to a trailer ball bracket 88 comprising a trailer ball 90. In this arrangement, the device 12 may be carried to a job site in the stowed position while at the same time a trailer is pulled behind the vehicle 10.

Figure 10:
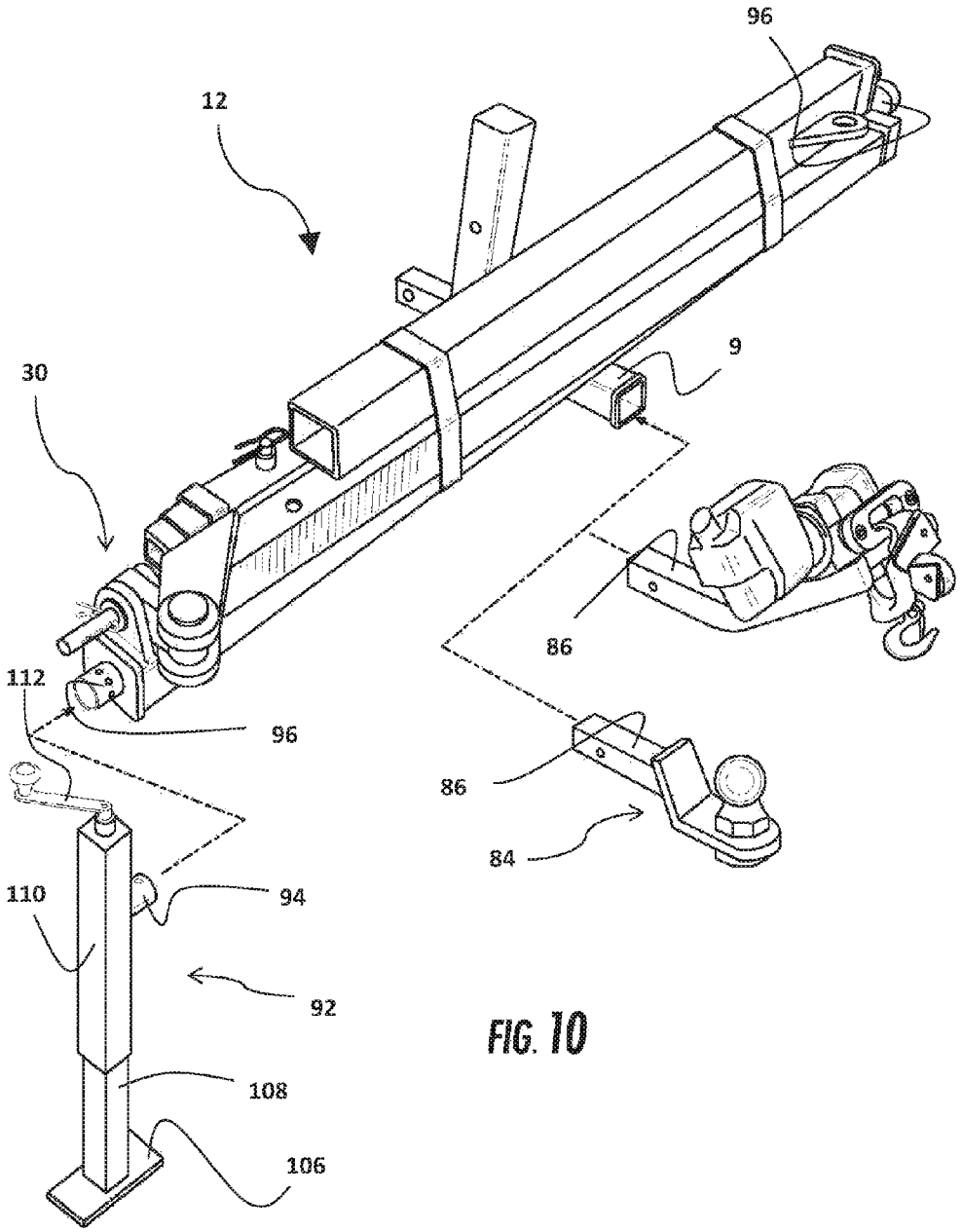
FIG. 10 is a perspective view of the hoist device in a folded position, in accordance with another embodiment.

Referring to FIG. 10, in some embodiments, the crosspiece 14 comprises a receiver 9 adapted to receive the trailer ball assembly 84 or the winch assembly 44. In such embodiments, the winch assembly 44, can be, for example, stored away from the device 12 while a trailer is towed behind the vehicle 10, the trailer being coupled to the trailer ball assembly 84. The winch assembly comprises a receiver insertion member 86 such that it can be inserted within the crosspiece receiver 9, when, for example, the user desires to use the device 12.

2. Extended Position

Figure 2:
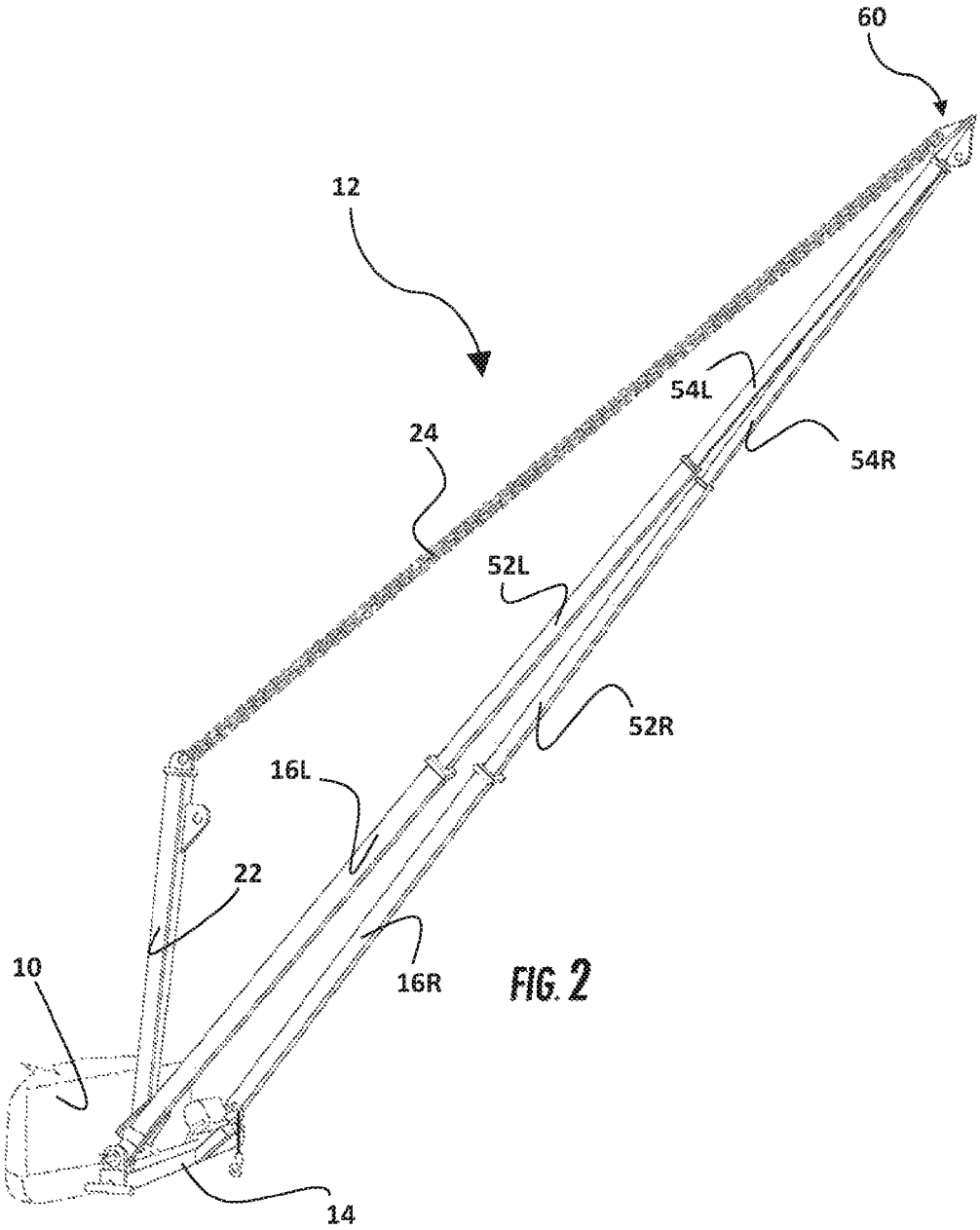
FIG. 2 is a perspective view of the hoist device in an extended position with the winch cable and hook retracted, in accordance with a preferred embodiment.
Figure 9:
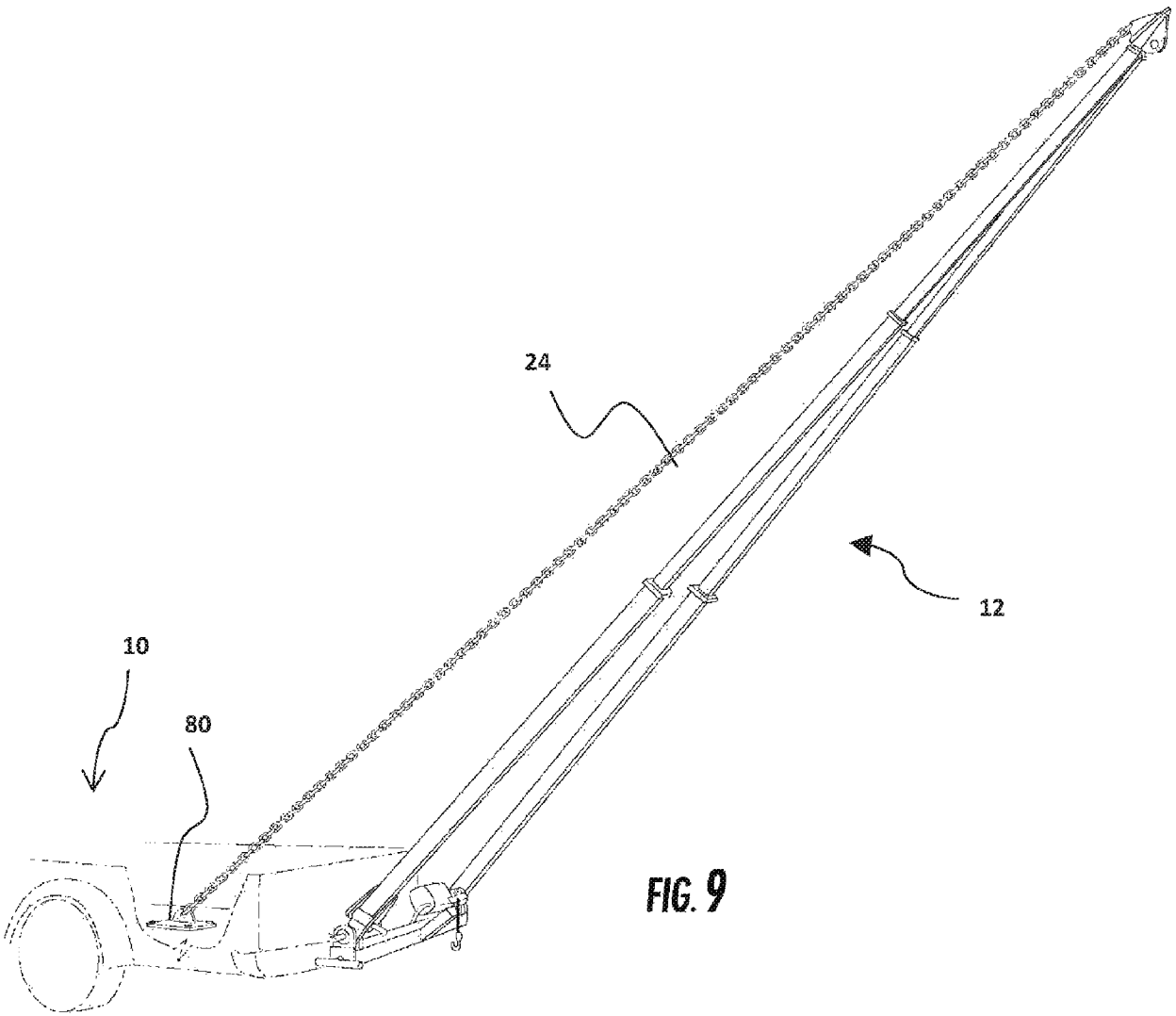
FIG. 9 is a perspective view of the hoist device in an extended position with the winch cable and hook retracted, in accordance with another embodiment.
Figure 11:
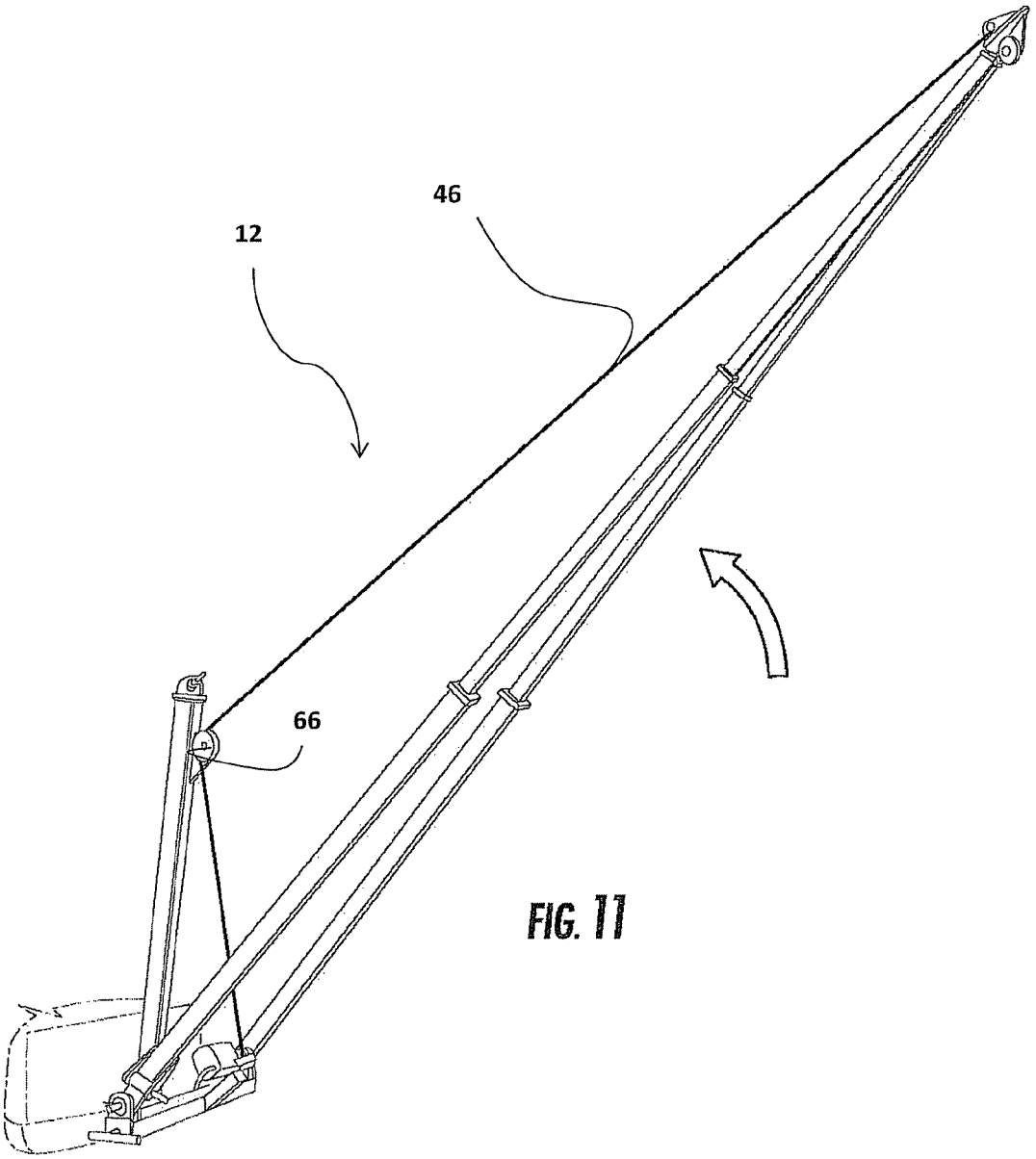
FIG. 11 is a perspective view of the hoist device an extended position with the winch cable in the raising position, in accordance with a preferred embodiment.

When the device 12 is moved from the stored position to the extended position depicted, for example, in FIGS. 2, 3, 5, and 9, the bands 58 are removed from the bundle 78 and the vertical extension member 22 is coupled to the vertical insertion member 20. The folding members 16L, 16R are moved outward away from each other. The folding members 16L, 16R, central members 52L, 52R, distal members 54L, 54R are extended such that the respective distal members 54L, 54R are extended from respective central members 52L, 52R, and respective central members 52L, 52R are extended from respective folding members 16L, 16R. The pins 32 are positioned to maintain the folding members 16L, 16R, central members 52L, 52R, distal members 54L, 54R in the extended position. The coupling member 60 is coupled to the distal members 54L, 54R. The vertical extension member 22 is coupled to the vertical insertion member 20. As shown in FIG. 11, the winch cable 46 is extended from the winch 44 over the vertical extension member 22 pulley 66 and coupled to the upper vertical boom plate 72 through opening 76. The winch 44 is then used to raise boom assembly 68 to the position shown in FIG. 11. As shown in FIGS. 2 and 9, the chain 24 is coupled to the upper vertical boom plate 72 through opening 76 and extended to either the vertical extension member 22 through opening 76 (FIG. 2) or to a bed plate 80 (FIG. 9) such that the boom assembly 68 is maintained in the upright position.

Referring to FIG. 10, in some embodiments, the device 12 is adapted to be coupled to one or more conventional and commercially available stabilizer assemblies 92. In a preferred embodiment, the device is adapted for coupling to two stabilizer assemblies 92—one positioned at each end of the crosspiece 14. The stabilizer assemblies comprise a pipe stabilizer coupling component 94 adapted to be coupled to a corresponding pipe crosspiece coupling component 96. Stabilizer coupling component 94 may be coupled to the crosspiece coupling component 96 with a pin 32 or other or other attachment device. The stabilizer assemblies 92 comprise a stabilizer base 106, a stabilizer lower portion 108, and a stabilizer upper portion 110. In the preferred embodiment, the conventional and commercially available stabilizer assemblies 92 comprise a gear box that permits the handle 112 to raise and lower the upper portions 110. The stabilizer lower portion 108 and stabilizer upper portion 110 are telescopically arranged such that the stabilizer assemblies 92 can each be lengthened by turning the respective handle 112. Such turning controls the distance between the stabilizer upper portion 110 and the stabilizer base 106. When coupled to the crosspiece 14 via the coupling components 94, 96, the upper portions 110 can be raised and lowered together such that the device 12 is more stable while lifting an object. The upper portions 110 of the stabilizer assemblies 92 can be raised, for example, such that one or more tires of the vehicle 10 are no longer in contact with the ground. The one or more stabilizer assemblies 92 can be used to stabilize or position the device 12 and/or vehicle 10 in other positions desired by the user.

3. Materials

In the preferred embodiment, portion of the device 12 are formed from square steel tube, a welded structural steel tube with an internal weld seam. Preferably, ASTM A513, ASTM A500 Grade B tubing is used. For example, square steel tube is used in forming the crosspiece 14, the receiver insertion member 18, the folding members 16L, 16R, central members 52L, 52R, and distal members 54L, 54R. In the preferred embodiment, ⅜" steel plate is used in forming other component parts of the device 12. For example, ⅜" steel plate is used in the component parts of the coupling member 60 and the pivoting assembly 30. Preferably ⅜" ASTM A36, AISI A-36 steel plate is used. Although the device of the preferred embodiment comprises ASTM A513, ASTM A500 Grade B tubing and ⅜" ASTM A36, AISI A-36 steel plate, other materials and other grades of materials may be used, depending upon the anticipated usage of the device 12 and lifting requirements of the user, without departing from the scope and spirit of the present disclosure.

C. Method

The present disclosure provides a method of lifting an object. The method of the preferred embodiment comprises the steps of providing a lifting device 12 removably coupled to a vehicle 10, the device comprising a crosspiece 14, a receiver insertion member 18, and two folding members 16L, 16R, the folding members 16L, 16R each positioned on an upper surface of the crosspiece 14 near opposite ends of the crosspiece 14; the folding members 16L, 16R comprising a pivoting assembly 30 coupling each folding member 16L, 16R to the crosspiece 14 such that each folding member 16L, 16R may be pivoted upward and towards each other 16L, 16R; each folding member 16L, 16R further comprising a telescopic arrangement such that the folding members 16L, 16R may be lengthened and shortened such that when in a lengthened position, the folding members 16L, 16R may be coupled to each other at the ends with a coupling member 60; moving the device from a stored portion to an extended position; using a winch 44, lifting an object.

In some embodiments of the method, the device 12 comprises a vertical extension member 22. In some embodiments of the method, the vertical extension member 22 is hingedly attached to an insertion member 18. In some embodiments of the method, the device 12 comprises a trailer ball assembly 84.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

I claim:

1. A portable lifting device adapted to be inserted into a vehicle receiver hitch, the device comprising:

a crosspiece, an insertion portion and first and second folding members;

the first and second folding members each comprising proximal and distal ends;

the first folding member comprising first and second pivoting members;

the second folding member comprising third and fourth pivoting members;

the crosspiece comprising an elongated length of material comprising first and second ends;

the insertion portion extending outward from the crosspiece such that the insertion portion is adapted for insertion into the vehicle receiver hitch;

the first folding member proximal end being pivotally coupled to the crosspiece proximate to the crosspiece first end;

the second folding member proximal end being pivotally coupled to the crosspiece proximate to the crosspiece second end;

the first pivoting member adapted to permit the first folding member to be pivoted vertically and the second pivoting member adapted to permit the first folding member to be pivoted horizontally;

the third pivoting member adapted to permit the second folding member to be pivoted vertically and the fourth pivoting member adapted to permit the second folding member to be pivoted horizontally;

the folding members being adapted to be pivoted towards each other;

each folding member further comprising a telescopic arrangement such that each folding member is adapted to be lengthened and shortened;

when in a lengthened position, the folding members' distal ends being adapted to be removably coupled to a coupling member;

the coupling member comprising a plate portion and first and second coupling extension portions;

the first coupling extension portion being elongated and comprising first coupling extension portion first and second ends;

the second coupling extension portion being elongated and comprising second coupling extension portion first and second ends;

the first and second coupling extension portion first ends being pivotally coupled to the plate portion;

the second end of the first coupling extension portion being adapted for removable coupling to the first folding member distal end;

the second end of the second coupling extension portion being adapted for removable coupling to the second folding member distal end;

the first and second coupling extension portions being adapted to pivot towards and away from each other when the coupling member is not coupled to the folding members; and when in a folded position, the folding members being retracted and turned inward such that each folding member aligns substantially parallel to the crosspiece.

2. The portable lifting device of claim 1 further comprising a vertical extension member.

3. The portable lifting device of claim 2 wherein, when in an extended working position, a chain is coupled to and extends between a top portion of the vertical extension member and the coupling member such that the folding members are positioned in an angled, upright, lifting position.

4. The portable lifting device of claim 3 further comprising a winch comprising a cable, the winch cable being extending from an area proximate to the crosspiece and through one or more pulleys such that the device is adapted to lift an object.

5. The portable lifting device of claim 4, the vertical extension member being pivotally coupled to the insertion portion.

6. The portable lifting device of claim 1 further comprising a trailer ball assembly.

7. A portable lifting device adapted to be inserted into a vehicle receiver hitch, the device comprising:

a crosspiece, an insertion portion, a vertical extension member, and first and second folding members; the insertion portion extending outward from the crosspiece such that the insertion portion is adapted for insertion into the vehicle receiver hitch;

the first and second folding members each comprising proximal and distal ends;

the first folding member comprising first and second pivoting members;

the second folding member comprising third and fourth pivoting members;

the crosspiece comprising first and second ends;

the first folding member proximal end being pivotally coupled to the crosspiece proximate to the crosspiece first end;

the second folding member proximal end being pivotally coupled to the crosspiece proximate to the crosspiece second end;

the first pivoting member adapted to permit the first folding member to be pivoted vertically and the second pivoting member adapted to permit the first folding member to be pivoted horizontally;

the third pivoting member adapted to permit the second folding member to be pivoted vertically and the fourth pivoting member adapted to permit the second folding member to be pivoted horizontally;

wherein the folding members are adapted to be pivoted towards each other;

each folding member further comprising a telescopic arrangement such that each folding member is adapted to be lengthened and shortened;

when in a folded position, the folding members being retracted and turned inward such that each folding member aligns substantially parallel to the crosspiece;

when in a lengthened position, each folding member is adapted to be removably coupled to each other at the respective folding members distal end with a coupling member;

the coupling member comprising a plate portion and first and second coupling extension portions;

the first coupling extension portion being elongated and comprising first coupling extension portion first and second ends;

the second coupling extension portion being elongated and comprising second coupling extension portion first and second ends;

the first and second coupling extension portion first ends being pivotally coupled to the plate portion;

the second end of the first coupling extension portion being adapted for removable coupling to the first folding member distal end;

the second end of the second coupling extension portion being adapted for removable coupling to the second folding member distal end;

the first and second coupling extension portions being adapted to pivot towards and away from each other when the coupling member is not coupled to the folding members;

when in an extended working position, the device is adapted for a chain to be coupled to and extend between a top portion of the vertical extension member and the coupling member such that the folding members are positioned in an angled, upright, lifting position; and the device further comprising a winch comprising a cable, wherein the winch cable is threaded from an area proximate to the crosspiece and through a pulley positioned near the coupling member such that the device is adapted to lift an object with the winch cable.

8. The portable lifting device of claim 7 further comprising a first stabilizer assembly removeably coupled to the crosspiece first end and a second stabilizer assembly removeably coupled to the crosspiece second end.

* * * * *